US009900712B2

(12) United States Patent
Galster et al.

(10) Patent No.: US 9,900,712 B2
(45) Date of Patent: Feb. 20, 2018

(54) USER ADJUSTMENTS TO A TINNITUS THERAPY GENERATOR WITHIN A HEARING ASSISTANCE DEVICE

(71) Applicant: Starkey Laboratories, Inc., Eden Prairie, MN (US)

(72) Inventors: Elizabeth Galster, Minneapolis, MN (US); Holly Schissel, Excelsior, MN (US); Penny Adine Tyson, Edina, MN (US); Michelle Lee Hicks, Victoria, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

(21) Appl. No.: 13/915,391

(22) Filed: Jun. 11, 2013

(65) Prior Publication Data

US 2013/0336508 A1 Dec. 19, 2013

Related U.S. Application Data

(60) Provisional application No. 61/659,794, filed on Jun. 14, 2012.

(51) Int. Cl.
*H04R 25/00* (2006.01)

(52) U.S. Cl.
CPC ..... *H04R 25/48* (2013.01); *H04R 25/75* (2013.01)

(58) Field of Classification Search
CPC ..... H04R 25/558; H04R 25/75
USPC ..... 381/314, 315
See application file for complete search history.

(56) References Cited

U.S. PATENT DOCUMENTS

| | | | | |
|---|---|---|---|---|
| 5,880,392 | A | 3/1999 | Wessel et al. | |
| 6,047,074 | A * | 4/2000 | Zoels et al. | 381/313 |
| 6,175,635 | B1 | 1/2001 | Meyer et al. | |
| 7,054,449 | B2 | 5/2006 | Ludi | |
| 7,349,549 | B2 | 3/2008 | Bachler et al. | |
| 8,135,138 | B2 | 3/2012 | Wessel et al. | |

(Continued)

FOREIGN PATENT DOCUMENTS

| | | | |
|---|---|---|---|
| DE | 10128642 | A1 | 1/2002 |
| DE | 102007046020 | A1 | 4/2009 |

(Continued)

OTHER PUBLICATIONS

Machine Translation of Reithinger German Publication No. DE10235501, Oct. 9, 2003.*

(Continued)

*Primary Examiner* — Katherine Faley
(74) *Attorney, Agent, or Firm* — Schwegman Lundberg & Woessner, P.A.

(57) ABSTRACT

Disclosed herein, among other things, are methods and apparatus for user adjustments to a tinnitus therapy generator within a hearing assistance device. One aspect of the present subject matter relates to a method of providing therapy for tinnitus to a patient. A user interface is provided for patient input to adjust settings of a tinnitus therapy generator. Sound is transmitted from the tinnitus therapy generator to the patient via a hearing assistance device receiver to provide therapy for tinnitus. In various embodiments, settings adjustable by the patient include output levels and frequency response. Other aspects are provided without departing from the scope of the present subject matter.

20 Claims, 1 Drawing Sheet

(56) References Cited

U.S. PATENT DOCUMENTS

| | | | | |
|---|---|---|---|---|
| 8,948,427 | B2 | 2/2015 | Wessel et al. | |
| 2003/0189881 | A1* | 10/2003 | Patil et al. | 369/30.18 |
| 2004/0071304 | A1 | 4/2004 | Yanz et al. | |
| 2005/0129262 | A1* | 6/2005 | Dillon | A61N 1/36032 381/312 |
| 2007/0076909 | A1 | 4/2007 | Roeck et al. | |
| 2009/0060214 | A1 | 3/2009 | Wessel et al. | |
| 2009/0292221 | A1* | 11/2009 | Viirre et al. | 600/544 |
| 2010/0016755 | A1* | 1/2010 | Henry et al. | 600/559 |
| 2010/0040247 | A1* | 2/2010 | Ypma et al. | 381/314 |
| 2011/0044482 | A1* | 2/2011 | Edgar | H04R 25/70 381/314 |
| 2011/0218593 | A1* | 9/2011 | Rubinstein et al. | 607/57 |
| 2011/0249841 | A1* | 10/2011 | Corti et al. | 381/315 |
| 2012/0134521 | A1 | 5/2012 | Wessel et al. | |

FOREIGN PATENT DOCUMENTS

| | | | |
|---|---|---|---|
| DE | 102008025485 | A1 | 7/2009 |
| EP | 0917398 | A2 | 5/1999 |
| EP | 1194005 | A2 | 4/2002 |
| EP | 2031900 | A2 | 3/2009 |
| EP | 2693774 | A1 | 2/2014 |
| WO | WO-2008011396 | A2 | 1/2008 |
| WO | WO-2009002539 | A2 | 12/2008 |

OTHER PUBLICATIONS

"European Application Serial No. 13171790.2, Extended European Search Report dated Aug. 19, 2013", 6 pgs.
"European Application Serial No. 13171790.2, Response filed May 30, 2014 to Extended European Search Report dated Aug. 19, 2013", 15 pgs.
"U.S. Appl. No. 12/190,582, Notice of Allowance dated Nov. 16, 2011", 8 pgs.
"U.S. Appl. No. 12/190,582, Response filed Oct. 13, 2011 to Restriction Requirement dated Sep. 13, 2011", 7 pgs.
"U.S. Appl. No. 12/190,582, Restriction Requirement dated Sep. 13, 2011", 6 pgs.
"U.S. Appl. No. 13/368,760, Non Final Office Action dated Jan. 16, 2014", 7 pgs.
"U.S. Appl. No. 13/368,760, Notice of Allowance dated Jun. 13, 2014", 5 pgs.
"U.S. Appl. No. 13/368,760, Notice of Allowance dated Sep. 25, 2014", 5 pgs.
"U.S. Appl. No. 13/368,760, Preliminary Amendment filed Apr. 10, 2012", 6 pgs.
"U.S. Appl. No. 13/368,760, Response filed May 16, 2014 to Non Final Office Action dated Jan. 16, 2014", 8 pgs.
"Cycling, 1974 Max/MSP", 1 pg.
"European Application Serial No. 08163218.4, Extended European Search Report dated Mar. 3, 2011", 9 pgs.
"European Application Serial No. 08163218.4, Invitation to Proceed dated Apr. 2011", 2 pgs.
"European Application Serial No. 08163218.4, Response filed Oct. 3, 2011 to Office Action dated Mar. 3, 2011", 10 pgs.
"European Application Serial No. 08163218.4, Result of Consultation dated Jan. 18, 2013", 3 pgs.
"European Application Serial No. 13174503.6, Amendment filed Jun. 3, 14", 9 pgs.
"European Application Serial No. 13174503.6, Extended European Search Report dated Oct. 2, 2013", 7 pgs.
Borg, Ingwer, et al., "Part I—Fundamentals of MDS", Modern Multidimensional Scaling: Theory and Applications Second Edition. Springer, New York, NY, (2005), 3-133.
Borg, Ingwer, et al., "Part II—MDS Models and Solving MDS Problems", Modern Multidimensional Scaling: Theory and Applications Second Edition. Springer, New York, NY, (2005), 135-289.
Borg, Ingwer, et al., "Part III—Unfolding", Modern Multidimensional Scaling: Theory and Applications Second Edition. Springer, New York, NY, (2005), 291-355.
Borg, Ingwer, et al., "Part IV—MDS Geometry as a Substantive Model", Modern Multidimensional Scaling: Theory and Applications Second Edition, Springer, New York, NY, (2005), 357-426
Borg, Ingwer, et al., "Part V—MDS and Related Methods", Modern Multidimensional Scaling: Theory and Applications Second Edition. Springer, New York, NY, (2005), 427-540.
Borg, Ingwer, et al., "Part VI—Appendices", Modern Multidimensional Scaling: Theory and Applications Second Edition. Springer, New York, NY, (2005), 541-614.
Carr, J C, et al., "Reconstruction and Representation of 3D Objects with Radial Basis Functions", Proceedings of the 28th Annual Conference on Computer Graphics and Interactive Techniques. (SIGGRAPH '01) 2001. Conference Proceedings, (2001), 67-76.
Chasin, M, et al., "Hearing Aids and Music", Trends in Amplification, 8 (2), (2004), 35-47.
Crandell, C C, "Individual Differences in Speech Recognition Ability: Implications for Hearing Aid Selection", Ear and Hearing, 12 (6), Supplement 100S-108S. (1991).
Edwards, B, "Hearing aids and hearing impairment", In S. Greenberg, W. Ainsworth, An. N. Popper, R. R. Fay, eds., Speech Processing in the Auditory System. Springer-Verlag, New York, NY, (2004), 339-421.
Fastl, H, "Psycho-acoustics and sound quality", In J. Blauert, ed., Communication Acoustics (Signals and Communication Technology). Springer, Berlin, Germany, (2005), 139-162.
Franks, J R, "Judgments of Hearing Aid Processed Music", Ear and Hearing 3, (1 ), (1982), 18-23.
Goldstone, R L, "An efficient method for obtaining similarity data", Behavior Research Methods, Instruments, & Computers, 26 (4), (1994), 381-386.
Momeni, D, et al., "Characterizing and controlling musical material intuitively with geometric models", In Proceedings of the 2003 Conference on New Interfaces for Musical Expression. Montreal, Canada, (2003), 54-62.
Punch, J L, "Quality judgments of hearing aid-processed speech and music by normal and otopathologic listeners", Journal of the American Audiology Society 3 (4), (1978), 179-188.
Shepard, R N, "Multidimensional Scaling, Tree-Fitting, and Clustering.", Science, 210(4468), (1980), 390-398.
Shepard, R N, "Psychological Representation of Speech Sounds", In E. David, P. B. Denes, eds., Human Communication a Unified View. McGraw-Hill, New York, NY, (1972), 67-113.
Tufts, J B, et al., "Perception of dissonance by people with normal hearing and sensorineural hearing loss", Acoustical Society of America Journal, 118, (2005), 955-967.
Wessel, D., et al., "Optimizing Hearing Aids for Music Listening", 19th International Congress on Acoustics, Madrid, Sep. 2-7, 2007, (Sep. 2007), 6 pages.
"European Application Serial No. 13171790.2, Communication Pursuant to Article 94(3) EPC dated Oct. 18, 2016", 5 pgs.

* cited by examiner

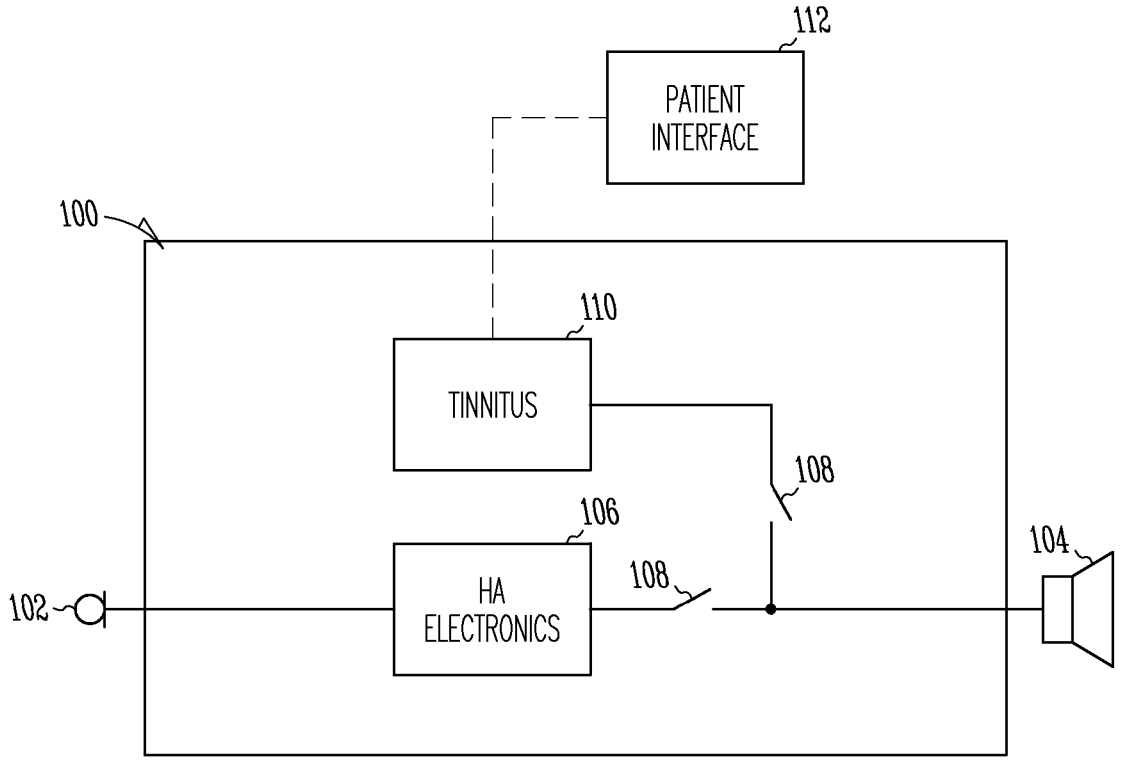
112
PATIENT INTERFACE
100
110
TINNITUS
108
106
104
108
102
HA ELECTRONICS

USER ADJUSTMENTS TO A TINNITUS THERAPY GENERATOR WITHIN A HEARING ASSISTANCE DEVICE

CLAIM OF PRIORITY AND INCORPORATION BY REFERENCE

The present application claims the benefit under 35 U.S.C. § 119(e) of U.S. Provisional Patent Application 61/659,794, filed Jun. 14, 2012, the disclosure of which is hereby incorporated by reference herein in its entirety.

FIELD OF THE INVENTION

The present subject matter relates generally to hearing assistance devices, and in particular to user adjustments to a tinnitus therapy generator within a hearing assistance device.

BACKGROUND

Modern hearing assistance devices, such as hearing aids, typically include digital electronics to enhance the wearer's listening experience. Hearing aids are electronic instruments worn in or around the ear that compensate for hearing losses by specially amplifying sound. Hearing aids use transducer and electro-mechanical components which are connected via wires to the hearing aid circuitry.

Tinnitus is a condition in which a patient perceives sound in their ear in the absence of corresponding external sound. While ringing of the ears is associated with tinnitus, other types of sounds can be perceived and can be sporadic, intermittent or continuous. Tinnitus can be caused by a number of conditions or injuries, but regardless of cause can be debilitating and decrease a patient's quality of life.

What is needed in the art is an improved system for generating tinnitus therapy.

SUMMARY

Disclosed herein, among other things, are methods and apparatus for user adjustments to a tinnitus therapy generator within a hearing assistance device.

One aspect of the present subject matter relates to a method of providing therapy for tinnitus to a patient. A user interface is provided for patient input to adjust settings of a tinnitus therapy generator. Sound is transmitted from the tinnitus therapy generator to the patient via a hearing assistance device receiver to provide therapy for tinnitus. In various embodiments, settings adjustable by the patient include but are not limited to output levels and frequency response.

One aspect of the present subject matter relates to system including a hearing assistance device for providing therapy for tinnitus to a patient. The system includes a tinnitus therapy generator configured to transmit sound to the patient via a hearing assistance device receiver to provide therapy for tinnitus. Various embodiments of the system include a user interface for patient input to adjust settings of the tinnitus therapy generator, the user interface in communication with the hearing assistance device. In various embodiments, settings adjustable by the patient include but are not limited to output levels and frequency response. Other aspects are provided without departing from the scope of the present subject matter.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

BRIEF DESCRIPTION OF THE DRAWINGS

FIG. 1 illustrates a block diagram of showing a signal path in a hearing assistance device used to provide therapy for tinnitus to a patient, according to one embodiment of the present subject matter.

DETAILED DESCRIPTION

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

The present subject matter relates generally to hearing assistance devices, and in particular to user adjustments to a tinnitus therapy generator within a hearing assistance device. The hearing assistance devices referred to herein include, but are not limited to hearing aids. One aspect of the present subject matter relates to a method of providing therapy for tinnitus to a patient. A user interface is provided for patient input to adjust settings of a tinnitus therapy generator. Sound is transmitted from the tinnitus therapy generator to the patient via a hearing assistance device receiver to provide therapy for tinnitus. The patient input is received from the user interface and used to adjust output level and frequency response of the sound transmitted by the hearing assistance device receiver to adjust the therapy for the tinnitus. Other settings of the tinnitus therapy can be adjusted without departing from the scope of the present subject matter Some hearing assistance devices include an interface for patients to adjust the gain and compression settings of their hearing aids. The present subject matter provides for patient adjustment of tinnitus therapy stimulus so that patients can program the spectrum of the tinnitus therapy stimulus, allowing for the selection of individually optimized settings. The subjective nature of tinnitus often makes it difficult for the professional to understand the patient's percept, and thus program sound therapy devices for the patient. There is no universally accepted prescription for sound therapy as patient variability prevents one treatment philosophy from being successful with all tinnitus patients. One advantage of the present subject matter is that the patient becomes an active participant in his or her treatment and can provide direct input in the programming of the tinnitus therapy stimulus, rather than indirect input to the professional, who then programs a sound therapy device for the patient.

Some previous devices provide a means by which the patient can adjust the volume of the tinnitus therapy sound. However the initial programming of the starting level and frequency response of the tinnitus therapy device is left up to the professional. These previous devices allow for only gross adjustment of level, restricting the patient's involvement in the selection and optimization of the tinnitus therapy stimulus. The present subject matter for the tinnitus therapy stimulus allows the patient to manually adjust the level and frequency response of the tinnitus sound generator via an intuitive, interactive user interface. Other settings of the tinnitus generator can be adjusted by the patient without departing from the scope of the present subject matter.

This present subject matter allows the tinnitus patient to provide direct input to the programming of the tinnitus therapy device. The patient is able to explore a variety of settings and choose the settings that are most comfortable, relaxing, and desirable, resulting in a treatment that is highly individualized. In various embodiments, the patient interface includes a computer. In one example, the computer has a keyboard and mouse interface. In another example, the computer has a touch screen instead of or in addition to the keyboard and mouse. Other interfaces, such as handheld devices and laptop devices, voice recognition, gesture sensing, etc. can be used without departing from the scope of the present subject matter. In various embodiments, existing hearing assistance device interfaces or fitting software can be used by the patient to adjust settings of the tinnitus therapy generator. One advantage of using these interfaces to adjust the tinnitus therapy stimulus is that it allows the patient to play an active role in the treatment of his/her tinnitus by exploring various settings for the tinnitus therapy stimulus and selecting the settings that are most appropriate for him/her.

Upon launching software for the tinnitus therapy stimulus, the patient begins with settings for the tinnitus therapy stimulus that are programmed to the device by the professional, in an embodiment. The layout of the space is generated specifically for those settings. Once that unique layout is generated, the patient is able to explore a variety of settings for the tinnitus therapy stimulus by moving a cursor through the space. These movements systematically adjust the output levels of the tinnitus therapy stimulus in 16 bands, independent of the amplification prescribed for treatment of hearing loss. As the patient moves the cursor, the settings for the tinnitus therapy stimulus update in real-time, allowing the patient to evaluate the sound quality of the therapy stimulus in an embodiment. The patient has the option of listening to any of the settings and easily comparing multiple settings. Once a favorite setting for the tinnitus therapy stimulus is determined, those parameters are stored to the programming software and the hearing aid, in various embodiments. Similar functionality could be achieved with an alternate user interface. For instance, the patient could manipulate the settings of the tinnitus therapy stimulus using an equalizer-like user interface. This present subject matter involves the patient in the fitting process and removes guesswork for the professional.

FIG. 1 illustrates a block diagram of showing a signal path in a hearing assistance device used to provide therapy for tinnitus to a patient, according to one embodiment of the present subject matter. The hearing assistance device 100 includes an input 102 connected to hearing aid electronics 106. Switches 108 are used to switch the device 100 from a first mode for normal hearing aid processing and a second mode for tinnitus therapy, in various embodiments. In tinnitus therapy mode, a tinnitus therapy generator (or tinnitus sound generator) 110 generates a signal to be used for tinnitus therapy. In various embodiments, a patient interface 112 is provided for patient input to adjust settings of the tinnitus therapy generator 110. The signal is presented to the user using the hearing assistance device receiver 104, or speaker. Tinnitus patients wear the device and alleviate the symptom by listening to the therapy, in various embodiments.

It is understood that variations in communications standards, protocols, and combinations of components may be employed without departing from the scope of the present subject matter. Hearing assistance devices typically include an enclosure or housing, a microphone, hearing assistance device electronics including processing electronics, and a speaker or receiver. Processing electronics include a controller or processor, such as a digital signal processor (DSP), in various embodiments. Other types of processors may be used without departing from the scope of this disclosure. It is understood that in various embodiments the microphone is optional. It is understood that in various embodiments the receiver is optional. Thus, the examples set forth herein are intended to be demonstrative and not a limiting or exhaustive depiction of variations.

The present subject matter can be used for a variety of hearing assistance devices, including but not limited to, cochlear implant type hearing devices, hearing aids, such as behind-the-ear (BTE), in-the-ear (ITE), in-the-canal (ITC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user. Such devices are also known as receiver-in-the-canal (RIC) or receiver-in-the-ear (RITE) hearing instruments. It is understood that other hearing assistance devices not expressly stated herein may fall within the scope of the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A method of using a hearing assistance device having a first mode of operation for hearing aid processing and a second mode of operation for tinnitus therapy, the method comprising:

displaying a user interface remote from the hearing assistance device for patient input to adjust settings of a tinnitus therapy generator and hearing assistance electronics in real time in the hearing assistance device, wherein layout of the user interface is customized based on initial settings programmed by a hearing professional, including a portion of the user interface selectable by the patient to provide audio resulting from multiple alternate settings and to compare audio from the multiple settings and select a favorite setting for each of the tinnitus therapy generator and hearing assistance electronics using a cursor, the tinnitus therapy generator configured to transmit sound to the patient via a hearing assistance device receiver during the second mode of operation, wherein the favorite setting is stored to memory in the hearing assistance device and stored to memory in a programming device connected to the user interface;

receiving the patient input from the user interface using the hearing assistance device; and using the patient input to adjust output level and frequency response of the sound transmitted by the hearing assistance device receiver during the first mode of operation and the second mode of operation.

2. The method of claim 1, wherein displaying the user interface includes providing a personal computer.

3. The method of claim 1, wherein displaying the user interface includes providing a keyboard.

4. The method of claim 1, wherein displaying the user interface includes providing a mouse.

5. The method of claim 1, wherein displaying the user interface includes providing a touch screen.

6. The method of claim 1, wherein displaying the user interface includes providing a gesture sensing input.

7. The method of claim 1, wherein displaying the user interface includes providing a voice recognition input.

8. The method of claim 1, wherein displaying the user interface includes providing an equalizer-like user interface.

9. The method of claim 1, wherein the hearing assistance device includes an in-the-ear (ITE) hearing aid.

10. The method of claim 1, wherein displaying the user interface includes providing for patient input to adjust output levels of the tinnitus therapy generator in 16 bands, independent of amplification prescribed for treatment of hearing loss.

11. A system including a hearing assistance device having a first mode of operation for hearing aid processing and a second mode of operation for providing therapy for tinnitus to a patient, the system comprising:

a tinnitus therapy generator configured to transmit sound to the patient via a hearing assistance device receiver to provide therapy for tinnitus during the second mode of operation; and a user interface remote from the hearing assistance device configured to receive a patient input to adjust settings of the tinnitus therapy generator and hearing assistance electronics in real time, the user interface in communication with the hearing assistance device, wherein layout of the user interface is customized based on initial settings programmed by a heating professional, including a portion of the user interface selectable by the patient to provide audio resulting from multiple alternate settings and to compare audio from the multiple settings and select a favorite setting for each of the tinnitus therapy generator and hearing assistance electronics using a cursor, wherein the patient input is used to adjust output level and frequency response of the sound transmitted by the heating assistance device receiver during the first mode of operation and to adjust the therapy for the tinnitus during the second mode of operation, and wherein the favorite setting is stored to memory in the hearing assistance device and stored to memory in a programming device connected to the user interface.

12. The system of claim 11, wherein the user interface includes a personal computer, keyboard, and mouse.

13. The system of claim 11, wherein the user interface includes a touch screen.

14. The system of claim 11, wherein the hearing assistance device includes a hearing aid.

15. The system of claim 14, wherein the hearing aid includes an in-the-ear (ITE) hearing aid.

16. The system of claim 14, wherein the aid includes a behind-the-ear (BTE) hearing aid.

17. The system of claim 14, wherein the hearing aid includes an in-the-canal (ITC) hearing aid.

18. The system of claim 14, wherein the hearing aid includes a receiver-in-canal (RIC) hearing aid.

19. The system of claim 14, wherein the aid includes a completely-in-the-canal (CIC) hearing aid.

20. The system of claim 14, wherein the hearing aid includes a receiver-in-the-ear (RITE) hearing aid.

* * * * *